United States Patent [19]

Engdahl, Jr.

[11] 4,034,907

[45] July 12, 1977

[54] BERRY BASKET AND METHOD OF MAKING SAME

[75] Inventor: Arnold Bernard Engdahl, Jr., Irvin, Calif.

[73] Assignee: Federal Paper Board Company, Inc., Montvale, N.J.

[21] Appl. No.: 668,462

[22] Filed: Mar. 19, 1976

[51] Int. Cl.[2] ..... B65D 5/26; B65D 5/22

[52] U.S. Cl. ..... 229/32; 229/16 C; 53/49 M

[58] Field of Search ..... 229/16 C, 16 A, 32, 229/34 R, 34 A

[56] References Cited

U.S. PATENT DOCUMENTS

| | | | |
|---|---|---|---|
| 1,917,132 | 7/1933 | LaBombarde | 229/34 R |
| 1,988,698 | 1/1935 | Newhouse | 229/16 C X |
| 2,022,566 | 11/1935 | Joslin | 229/16 C X |
| 2,106,816 | 2/1938 | Shimizu et al. | 229/32 |
| 2,279,670 | 4/1942 | Ford et al. | 229/32 |
| 2,366,602 | 1/1945 | De Haven | 229/34 A |
| 3,246,830 | 4/1966 | Smith | 229/32 |

*Primary Examiner*—Davis T. Moorhead
*Attorney, Agent, or Firm*—Guy A. Greenawalt

[57] ABSTRACT

A berry box or basket and a method of forming the same from a rectangular blank of foldable stock material which is cut and scored to provide, when set up, a square bottom wall, side wall members slanted upwardly and outwardly therefrom with one pair thereof which are disposed opposite each other reinforced and rigidified by connecting glue flaps which are cut from the material at the corners of the blank and hinged to the vertical edges of the adjoining side wall members and which have top marginal portions folded down and secured to the face of the remainder of the flaps so as to stiffen and reinforce the top edge of the wall, and the top margins of the adjoining side wall members being reinforced by a folded down edge strip while the corners are reinforced by small tab members which are each integrally hinged to the edge reinforcing strip or flap on the adjoining wall member.

3 Claims, 4 Drawing Figures

BERRY BASKET AND METHOD OF MAKING SAME

This invention relates to containers and is more particularly concerned with improvements in open top, tray-like containers which are particularly adapted for packaging small fruit or vegetables, such as, berries or the like.

In the marketing of various small fruit and vegetables, particularly, berries and similar produce, the familiar small wooden baskets which hold a pint or quart of the fruit are rapidly being replaced by baskets of similar size and shape which are formed from foldable paperboard or other sheet material or from moldable or formable pulp or plastic material. In the manufacture of such baskets from foldable sheet material, such as paperboard stock, the material selected is most often relatively thin so as to achieve maximum economy. Such baskets are formed by cutting, scoring and gluing a blank and, generally, plunger forming the basket. Consequently, fabrication of the container may require relatively complicated machine operations, particularly, when any provision is made for reinforcing the side walls. Some reinforcing is considered desirable so as to stiffen the relatively thin material and to withstand handling without material damage to the contents. Also, some of the designs suggested have involved the application of top edge reinforcing strips which leave exposed sharp edges likely to damage the berries or other contents and which require special machines for fabrication, thereby increasing the cost to an extent which is objectionable and which is a disadvantage in competing with baskets formed of plastic or similar materials. It is, therefore, a general object of the present invention to provide a container of the berry basket type which may be formed from a blank of foldable sheet material, such as, cardboard, cut and scored to provide improved top edge reinforcing and which may be cut, glued and formed on conventional box making machinery with little or no modification and with maximum economy of materials and labor.

It is a more specific object of the invention to provide an improved berry box or basket and a method of forming the same from a blank of foldable paperboard or other suitable sheet material which incorporates side wall members with reinforcing and stiffening means including, in part, top rim or edge reinforcing members which are derived from otherwise waste areas of the blank and corner reinforcing members which are integrally hinged thereto and which are secured relative to the edge reinforcing strips of the adjoining side wall members so as to provide edge reinforcing which bridges the corners of the basket.

It is a further object of the invention to provide a berry basket and a method of forming the same from a cut and scored blank of foldable paperboard, or the like, wherein the basket incorporates a bottom wall with upstanding side walls which have integral folded down edge reinforcing members including connecting tabs so arranged that they span the corners of the basket and wherein the blank is cut and scored so that the application of an adhesive and the initial folding of the edge reinforcing members may be conveniently accomplished on a conventional straight line carton forming machine.

It is another object of the invention to provide a container in the form of a berry basket and a method of forming the same from a paperboard blank or other suitable foldable sheet material which is characterized by a bottom wall, upstanding side walls and top edge reinforcing and stiffening means which includes reinforcing panels taken from opposite sides of the blank and are folded so as to provide edge reinforcing strips extending down from the top edges of the side walls with connecting tabs at the corners of the basket which are each integral with an edge reinforcing strip on one wall and secured to the adjoining wall so as to bridge the corner formed by the juncture of the two walls.

It is still another object of the invention to provide a berry basket with top edge reinforced side walls wherein top edge reinforcing strips are cut from the material at opposite sides of a blank of foldable sheet material from which the basket is made, which reinforcing strips are folded and secured to side wall forming panels by advancing the blank on a straight line machine which applies lines of adhesive to the faces of the reinforcing strips and folds the same into engagement with the adjoining portions of the blank in a folding sequence which results in positioning corner reinforcing tabs at the trailing ends of leading reinforcing strips in underlying engagement with the leading ends of trailing reinforcing strips.

The foregoing objects and advantages are obtained by cutting and scoring a blank of foldable paperboard or other suitable sheet material so as to provide a center bottom wall forming panel and side wall forming panels which extend from the edges of the bottom wall together with reinforcing panels cut from the four corners of the blank which are subdivided to provide along the outer side edges of the blank hinged edge reinforcing strips which are freed from edge reinforcing strips formed along the intermediate side marginal portions of the blank so as to leave at one end thereof integral hinged corner connecting tabs which are adapted to be connected so as to span the associated corners of the basket, while at the other ends of the intermediate side edge reinforcing strips hinged corner connecting tabs are cut which are adapted for spanning the associated vertical corners of the basket and for connection to the edge reinforcing strips on the adjoining corner panels at that end of the blank. The blank is provided with lines of adhesive extending along the side margins in the edge reinforcing strip areas by advancing it on a straight line machine which applies the lines of adhesive and folds the edge reinforcing strips in a predetermined sequence so that the corner connecting tabs on the edge reinforcing strips are positioned in proper corner spanning or bridging position and secured so that upon plunger forming of the blank to complete the container the corners are reinforced by the connecting tabs.

A clear understanding of the invention may be had by consideration of the hereinafter described procedures and the berry basket type container which is illustrated in the accompanying drawings wherein.

Figure 1:
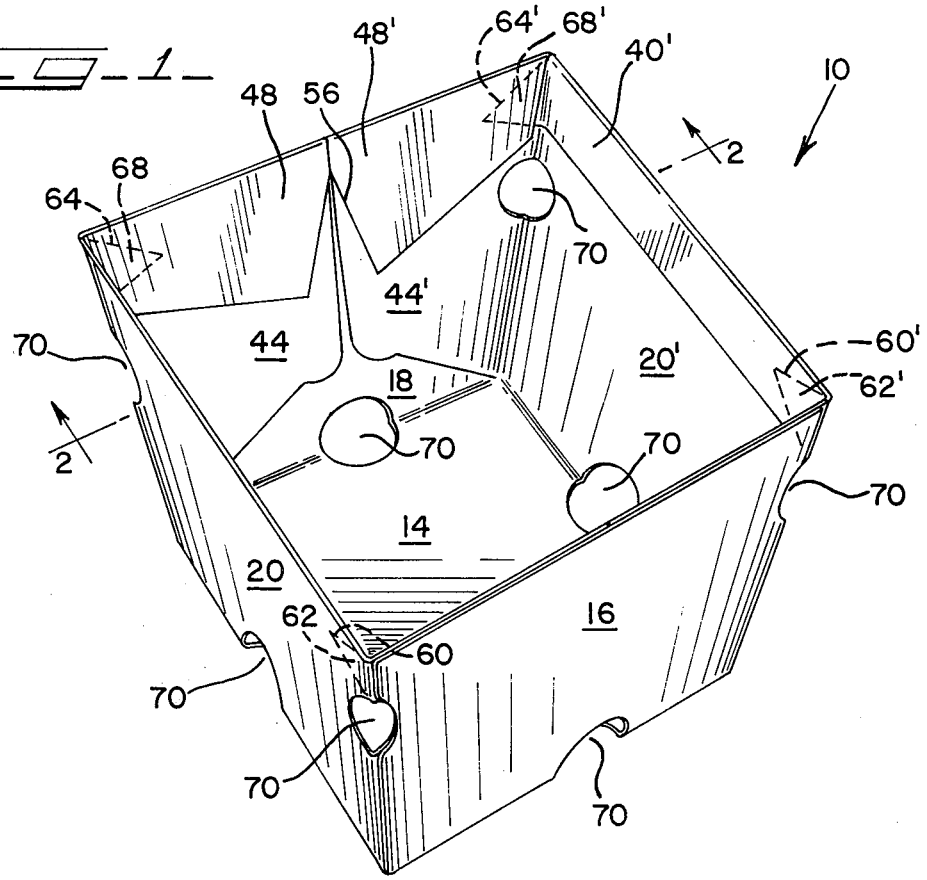
FIG. 1 is a perspective view of a berry box or berry basket which embodies therein the principal features of the invention.

Referring first to FIG. 1 of the drawings, there is illustrated the preferred form of a tray-like open top container 10 which embodies the principles of the invention. The illustrated container is fabricated from relatively thin paperboard stock material following a procedure which enables the use of conventional machinery employed in the fabrication of cartons from foldable sheet material. The illustrated container is designed particularly for use in packaging a predetermined quantity, such as, a pint or a quart, of berries, or similar products. It has a configuration corresponding to that of the familiar wooden berry box or basket which it is intended to replace.

Figure 2:
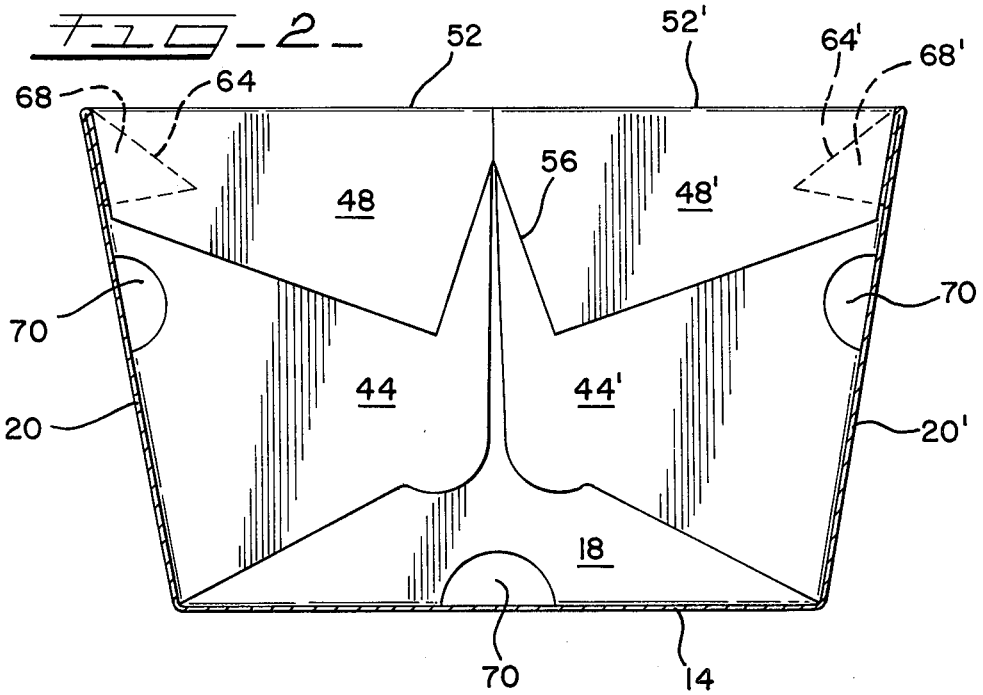
FIG. 2 is a cross sectional view taken on the line 2—2 of FIG. 1, to an enlarged scale.
Figure 3:
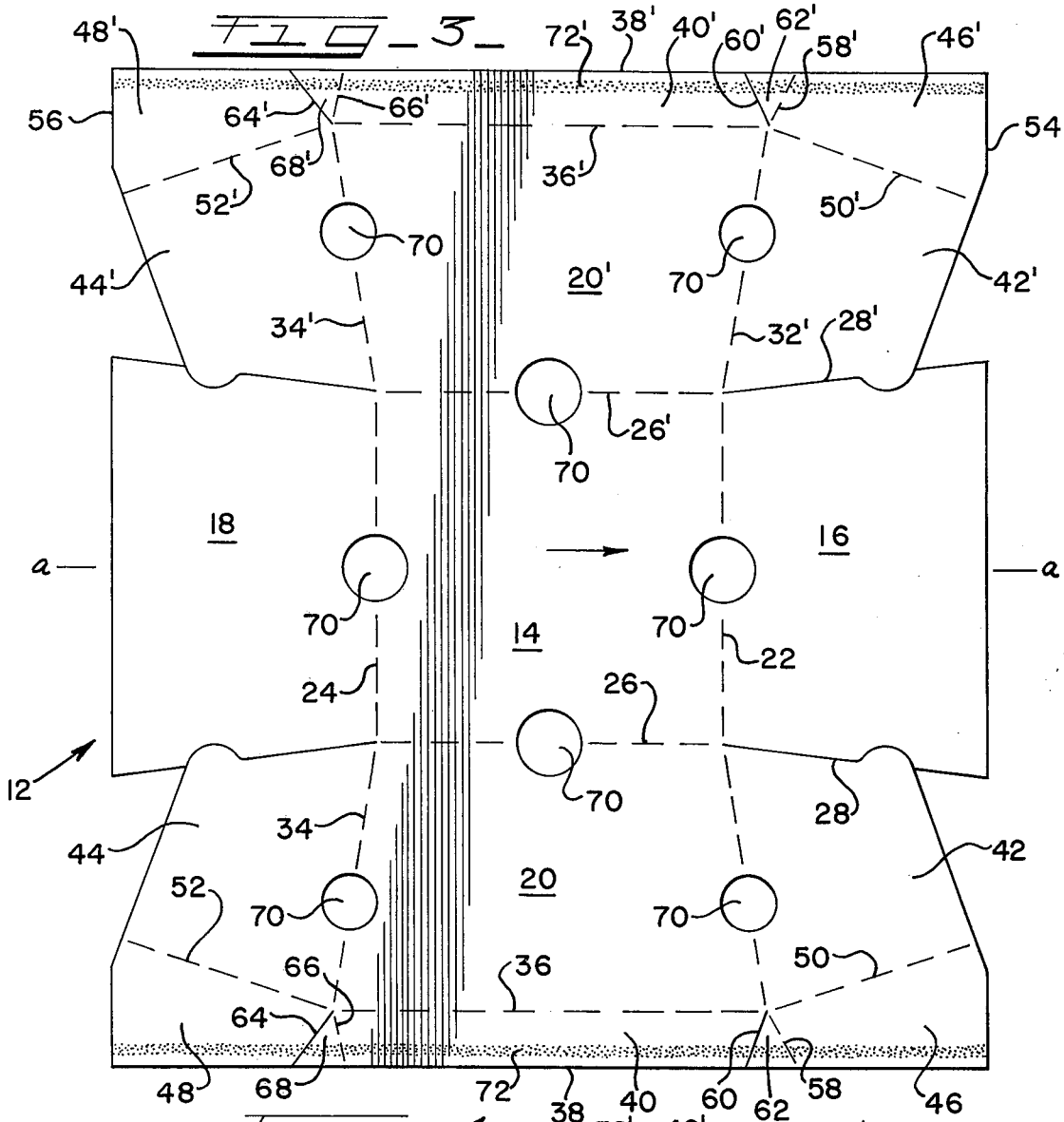
FIG. 3 is a plan view of a paperboard blank which is cut and scored preparatory to the forming of the berry basket which is shown in FIG. 1.
Figure 4:
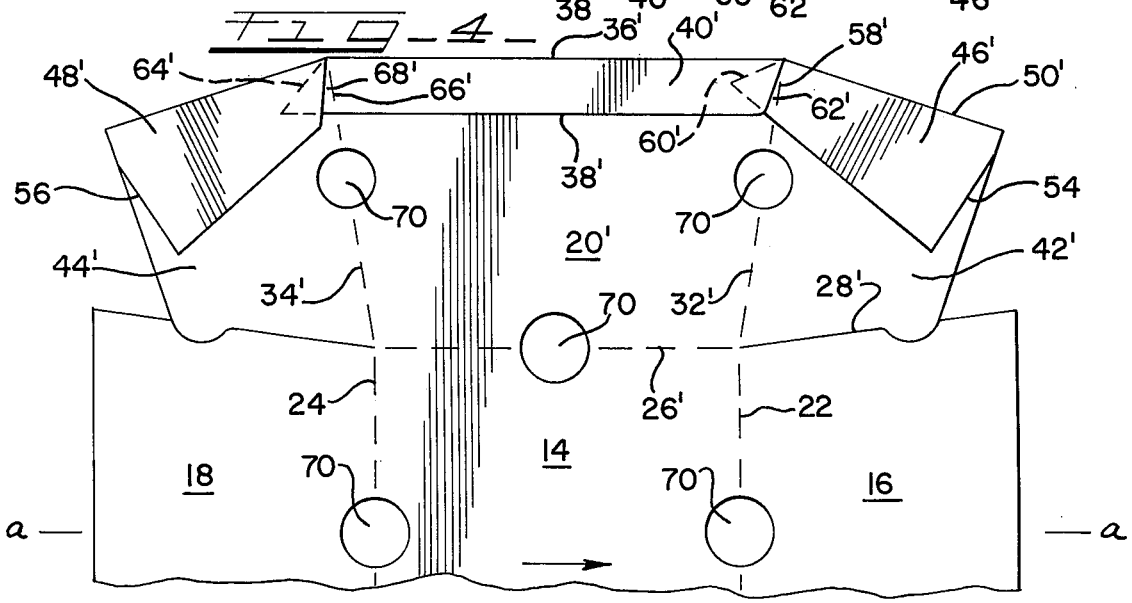
FIG. 4 is a fragmentary plan view of the blank of FIG. 4 which is partially folded in preparation for a plunger folding operation for setting up or completing the formation of the berry basket of FIG. 1.

The procedure for forming the container 10 will be best understood with reference first to the cut and scored paperboard blank 12, which is illustrated in FIG. 3. The blank 12, which is generally rectangular, may be cut from a web or sheet of larger dimensions. It is cut and scored so as to provide the required container wall forming and reinforcing panels, which characterize the container of FIGS. 1 and 2. The cut and scored blank 12 is symmetrical about the center line *a—a*, the latter extending in the direction of the blank which corresponds to the direction of travel through the straight line machine on which the adhesive is applied and the initial folds are made and which is indicated by the arrow in the center panel 14.

The blank 12 is cut and scored to provide a center panel 14, which is adapted to form the bottom wall of the finished container, and four side wall forming panels 16, 18, 20 and 20′ which, in the square bottom container illustrated, are of the same size and configuration. The center panel 14 is defined by the spaced, parallel, transversely extending score lines 22, 24 and longitudinally extending score lines 26, 26′. The score lines 26, 26′ extend in the direction of travel of the blank, which, for convenience in description may be termed the longitudinal direction, while the score lines 22, 24 extend in spaced relation transversely of the score lines 26, 26′. The spacing of the two pairs or sets of score lines is the same with the panel 14 being square. The configuration of panel 14 could be rectangular in either direction with the associated panels properly dimensioned for the fabrication of a container of rectangular shape.

The side wall forming panels 16 and 18 extend from the transverse score lines 22 and 14, respectively, and are of truncated triangle shape with the side edges defined by cutting lines 28, 28′ and 30, 30′. The cutting lines 28, 28′ extend in outwardly diverging relation from the intersection of the transverse score line 22 with the longitudinal score lines 26, 26′ and the longitudinal dimension of the panels 16 and 18 corresponds to the desired side wall depth of the completed container. The side wall forming panels 20 and 20′ are defined by the bottom edge defining score lines 26, 26′, the side edge defining score lines 32, 34 and 32′, 34′, and the top edge defining score lines 36, 36′. The longitudinally spaced score lines 32, 34 and 32′, 34′ extend in diverging relation outwardly of the intersection of the score lines 26, 26′ with the transverse score lines 22, 24 at opposite ends of the latter and terminate at the ends of the longitudinal score lines 36, 36′, the latter being parallel with each other and inwardly spaced from the side edges 38, 38′ of the blank a sufficient distance to provide relatively narrow strips or panels 40, 40′ along opposite side margins of the blank. The side wall forming panels 20 and 20′ thus have a configuration the same as the side wall forming panels 16 and 18 with the dimensions between the top and bottom edge defining lines 36, 26 and 36′, 26′ corresponding approximately to the longitudinal dimension of the panels 16 and 18 which is the wall depth dimension desired for the container. The configuration of the side wall panels 16, 17, 20 and 20′ is designed to provide an upward and outward slant relative to the bottom wall 14 for these panels, in the final form of the container, as illustrated in FIGS. 1 and 2.

The four corners of the blank are cut and scored to provide pairs of side wall reinforcing and stiffening panels 42, 42′ and 44, 44′ together with associated top edge reinforcing panels 46, 46′ and 48, 48′. The reinforcing panels 42, 42′ and 44, 44′ also constitute corner connecting panels for securing the oppositely disposed side wall panels 20, 20′ to the side wall panels 16 and 18.

The edge reinforcing panels 46, 46′ and 48, 48′ are separated from the corner connecting and reinforcing panels 42, 42′ and 44, 44′ by score lines 50, 50′ and 52, 52′ which extend from the ends of the score lines 36, 36′ and the outer terminal ends of the score lines 32, 32′ and 34, 34′ in the direction of the leading and trailing ends or edges 54 and 56 of the blank 12. The score lines 50, 50′ and 52, 52′ are angled inwardly in the direction of the center line *a—a* of the blank with the angle of inclination relative to the score lines 36, 36′ corresponding approximately to the angle of outward inclination of the side walls in the completed container so that in the completed or set up container, with the panels 42, 42′ and 44, 44′ secured to the associated side wall panels 16, 18, the folds on the lines 50, 50′ and 52, 52′ will co-operate with the top or end edges of the panels 16, 18 in forming the top edges of the oppositely disposed, reinforced container side walls formed by the panels 16, 18. The edge reinforcing panels or strips 46, 46′ at the leading end of the blank are scored on the lines 58, 58′ which are angled outwardly and forwardly toward the leading end 54 of the blank with the angle between the lines 58, 58′ and the score lines 50, 50′ corresponding approximately to the angle between the score lines 50, 50′ and the transverse score lines 32, 32′ so that when the panels 46, 46′ are folded about the score lines 50, 50′ the score lines 58, 58′ will be approximately aligned with the outer end portions of the score lines 32, 32′. The panels 46, 46′ are separated or freed at their trailing ends from the leading ends of the edge reinforcing panels or strips 40, 40′ on cutting lines 60, 60′ which extend from the ends of the score lines 36, 36′ and the transverse score lines 32, 32′ to the side edges 38, 38′ of the blank 12. The cutting lines are angled outwardly in the direction of the blank side edges 38, 38′ and rearwardly in the direction of the trailing end edge 56 of the blank with the angle between the cutting lines 60, 60′ and the score lines 36, 36′ being approximately the same or somewhat less than the angle between the transverse score lines 32, 32′ and the score lines 36, 36′ which results in triangular corner connecting and reinforcing tabs 62, 62′ being formed between score lines 58, 58′ and cutting lines 60, 60′ for bridging, or spanning, the corners at the top edge or margin of the completed container. At the trailing end of the blank the top edge reinforcing panels or strips 48, 48′ are cut on the lines 64, 64′ which may be generally parallel with the cutting lines 60, 60' and which extend from the ends of the score lines 36, 36' in the direction of the side edges 38, 38' and the trailing end edge 56 of the blank at an angle relative to the score lines 52, 52' which is the same or somewhat less than the angle between the score lines 34, 34' and the score lines 52, 52'. The edge reinforcing panels 36, 36' are scored on the lines 66, 66' which extend outwardly in the direction of the side edges 38, 38' of the blank and at an angle relative to the score lines 36, 36' which is approximately the same as the angle between the score lines 34, 34' and the score lines 36, 36' resulting in generally triangle edge reinforcing corner connecting tabs 68, 68' on the trailing ends of the edge reinforcing panels or strips 36, 36'. The tabs 68, 68' are adapted to serve the same purpose as the corner connecting and reinforcing tabs 62, 62', that is, to connect the edge reinforcing strips or panels 40, 40' with the strips or panels 48, 48' and bridge or span the container corners. The blank 12 is perforated as shown at 70 to provide for adequate air circulation when the container is used for berries or the like.

In forming the container 10 from the cut and scored blank 12 the latter is advanced through a straight line adhesive applying and folding machine of conventional design which applies lines 72, 72' of hot melt adhesive on the side margins of the blank. The adhesive lines 72, 72' are disposed so as to traverse the panels 36, 36' and the associated panels 46, 48 and 46', 48' including the corner connecting tabs 62, 68 and 62', 68'. The edge reinforcing panels are then folded in the proper sequence. The panels 46, 46' at the leading end are folded about the score lines 50, 50' followed by the folding of the panels 40, 40' about the score lines 36, 36' and finally the panels 48, 48' about the score lines 52, 52'. This results in the top edge corner connecting tabs 62, 62' falling beneath the leading ends of the panels 36, 36' and the tabs 68, 68' falling beneath the leading ends of the panels 48, 48' where they are overlapped by the successive or sequence folding of the edge reinforcing panels. The blank is then in condition for completing the folding or setting up of the container or carton 10 on a conventional plungertype carton forming machine with the application of a hot melt adhesive on the corner connecting panels 42, 42' and 44, 44' and the folding of these panels and the wall panels 16, 18 and 20, 20' so as to bring the panels 42, 42' and 44, 44' into engagement with the inner or outer faces of the wall panels 16 and 18, the latter being positioned on the outside of the container, in the form shown in FIGS. 1 and 2, thereby providing a generally smooth outside wall surface. The necessary heat is applied during the forming to activate the adhesive where and when required to secure the panels in the position shown in FIGS. 1 and 2.

The panel arrangement enables the initial forming on a straight line gluing and folding machine, of the edge reinforcing, with the folding of the panels in the proper sequence, to bring the corner connecting tabs 62, 62' and 68, 68' in corner bridging or spanning relation at each of the corners of the container when the latter is completed. This provides the advantage of relatively high speed fabrication of the container with highly reliable operation on machinery of conventional design and results in a reinforcing of the container top edges or margins in a manner which strengthens and rigidifies the container walls so as to reduce the risk of tearing in use while avoiding contact of the contents with exposed raw edges in a manner which minimizes the likelihood of damage to the contents.

I claim:

1. A blank for fabricating an open top container in the form of a berry basket which blank is formed of foldable paperboard or similar sheet material, said blank being cut and scored so as to provide a center bottom wall forming panel and side wall forming panels which extend from the edges of the bottom wall together with reinforcing panels cut from the four corners of the blank which are subdivided to provide along the outer side edges of the blank hinged edge reinforcing strips which edge strips are cut free from edge reinforcing strips formed along the intermediate side marginal portions of the blank, said strips being cut so as to leave at one end thereof integral hinged corner connecting tabs which are adapted to be connected so that when the container is completely formed they span the associated corners of the container, the other ends of said intermediate side edge reinforcing strips being cut so as to provide corner connecting tabs which are adapted for spanning the associated vertical corners of the container and for connection to edge reinforcing strips which are cut in the adjoining corner panels at that end of the blank, said reinforcing panels being scored to provide hinge lines for folding into overlying engagement with the adjoining side wall panel and said blank having strips of adhesive extending along the side margins and in the edge reinforcing strip areas enabling the edge reinforcing strips to be folded down onto adjoining blank areas in a predetermined sequence so that the corner connecting tabs on the edge reinforcing strips are engaged in corner spanning or bridging relation with the side wall forming panels and secured upon folding of the blank to complete the container whereby the corners are reinforced by said connecting tabs.

2. A blank for fabricating an open top container as set forth in claim 1 wherein said edge reinforcing strips are defined by hinge forming score lines extending in part parallel with the side edges of the blank and in part diagonally inwardly of said blank side edges and said adhesive strips extend in straight lines parallel with said blank side edges and spaced inwardly thereof.

3. A container in the form of a berry basket which is formed from a paperboard blank or similar foldable sheet material and which comprises a bottom wall forming panel, side wall forming panels upstanding from the side edges of the bottom wall panel, side wall reinforcing and corner connecting panels hinged to the side edges of oppositely disposed side wall forming panels and secured in overlying relation on the inside faces of the adjoining side wall forming panels which are disposed opposite each other, and relatively narrow top edge reinforcing strip members extending about the top margins of the basket which are integral with the side wall corner connecting panels and the associated side wall forming panels to which said corner connecting and reinforcing panels are hinged, said top edge reinforcing strip members being folded down so as to lie along the top margins of the basket side wall members and being adhesively secured to the top marginal face portions of said side wall corner connecting panels and said side wall forming panels, and top edge corner reinforcing tabs at each corner of the basket each of which is integral with an edge reinforcing strip portion lying along the top margins at one side wall of the basket and which is adhesively secured between the edge reinforcing strip portion lying along the adjoining wall of the basket and the associated top margin of said wall.

* * * * *